United States Patent [19]

Speckhart

[11] 4,173,954

[45] Nov. 13, 1979

[54] LIMITED ROTATION ROLLER TAPPET

[76] Inventor: Frank H. Speckhart, 534 Dellwood Dr., Knoxville, Tenn. 37919

[21] Appl. No.: 860,210

[22] Filed: Dec. 13, 1977

[51] Int. Cl.[2] ..... F01L 1/14

[52] U.S. Cl. ..... 123/90.5; 123/90.48; 74/569

[58] Field of Search ..... 123/90.48, 90.5; 74/569

[56] References Cited

U.S. PATENT DOCUMENTS

| | | | |
|---|---|---|---|
| 1,802,330 | 4/1931 | Boland | 123/90.5 |
| 2,846,988 | 8/1958 | Iskenderian | 123/90.5 |
| 3,101,077 | 8/1963 | Engle | 123/90.5 |
| 3,108,580 | 10/1963 | Crane | 123/90.5 |
| 3,139,076 | 6/1964 | Flaherty | 123/90.5 |
| 3,180,328 | 4/1965 | Engle | 123/90.5 |

*Primary Examiner*—Charles J. Myhre
*Assistant Examiner*—Jeffrey L. Yates
*Attorney, Agent, or Firm*—Robert S. Alexander

[57] ABSTRACT

A limited rotation roller tappet having an aperture and a slot formed in it. A locking bar having a narrow end portion and a shoulder portion prevents rotation of the tappet. The end portion of the locking bar is adapted to pass through both the aperture and the slot while the shoulder portion will not pass through the aperture. The locking bar preferably has a second narrow end portion and is held in place by a second similar roller tappet adjacent to the first having a slot through which the second end portion passes and an aperture through which the shoulder portion will not pass.

11 Claims, 9 Drawing Figures

LIMITED ROTATION ROLLER TAPPET

DETAILED DESCRIPTION OF PREFERRED EMBODIMENTS

Figure 1:
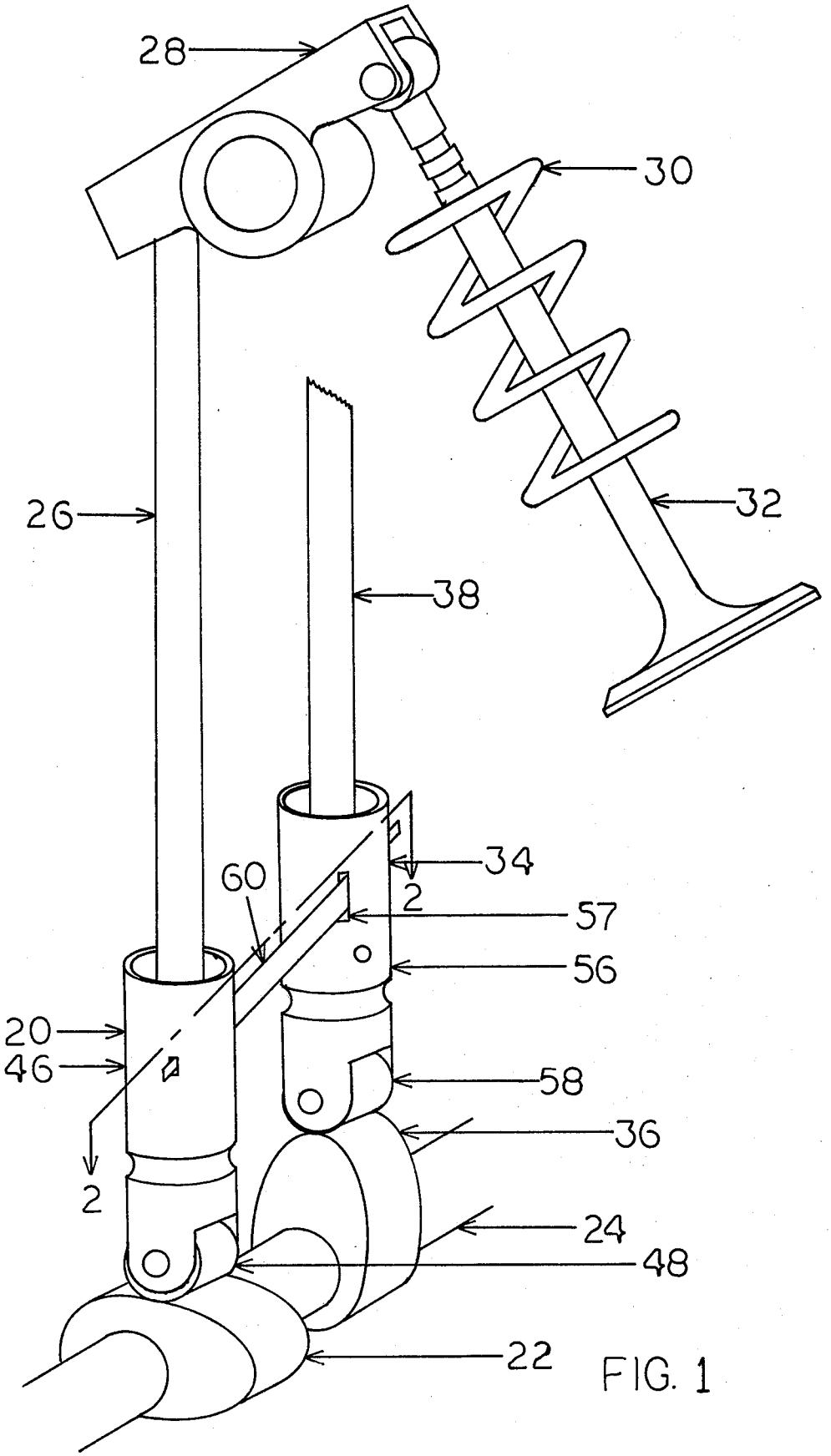
FIG. 1 illustrates the valve lifter mechanisms for a pair of adjacent valves.

Referring now to the drawings and specifically to FIG. 1, the valve lifter mechanisms for a pair of adjacent valves are illustrated. In most embodiments, the adjacent lifter mechanisms will operate the intake and exhaust valves on the same cylinder although it is only necessary that said lifter mechanisms be adjacent to each other. The left lifter mechanism comprises a left roller tappet 20 disposed within a bore in the engine block (not shown) and engaging cam surface 22 on camshaft 24. The upper portion of left roller tappet 20 engages pushrod 26 which is pivotably joined to rocker arm 28 which is biased to press pushrod 26 down by the action of valve spring 30 which encircles the stem of valve 32 and presses against the cylinder head (not shown). The right lifter mechanism similarly comprises right roller tappet 34 disposed within a bore in the engine block (not shown) and engaging cam surface 36 on camshaft 24. The upper portion of right roller tappet 34 engages pushrod 38 which is pivotably joined to the right rocker arm (not shown) which is biased to press pushrod 38 down by the action of the right valve spring (not shown) which encircles the stem of right valve (not shown) and presses against the cylinder head (not shown). Left roller tappet 20 comprises left tubular member 46 having a bifurcation formed in the lower end thereof and roller bearing 48 rotably mounted in said bifurcation. Right roller tappet 34 similarly comprises right tubular member 56 having a bifurcated lower end and roller bearing 58 rotatably mounted in said bifurcation.

Figure 2:
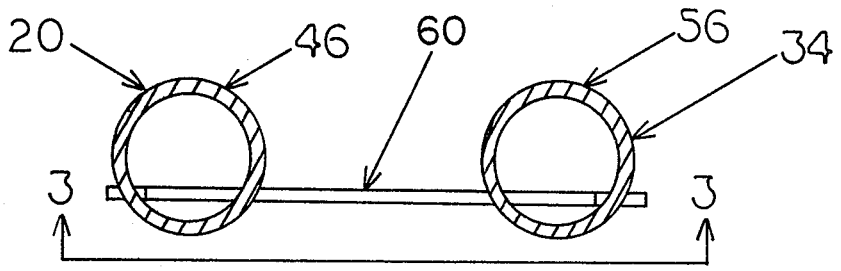
FIG. 2 is a sectional view along line 2—2 in FIG. 1.
Figure 3:
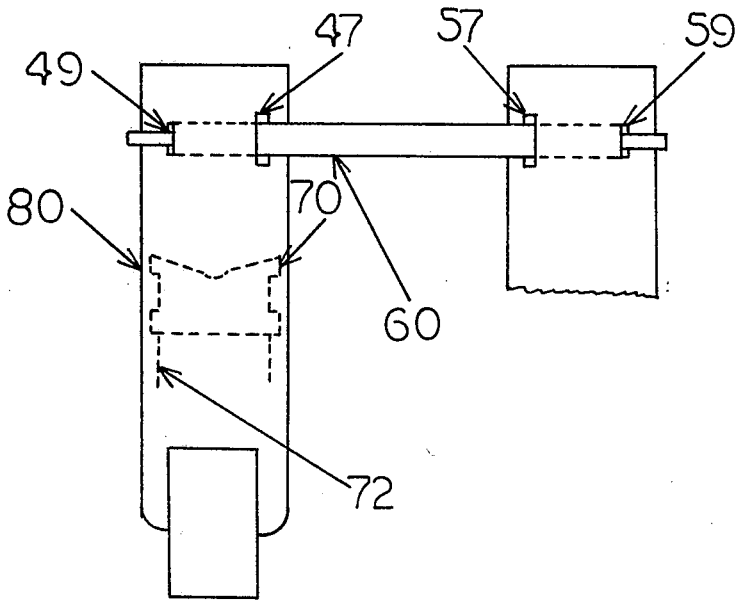
FIG. 3 is a side elevation of a pair of lifter bodies of the present invention.
Figure 4:
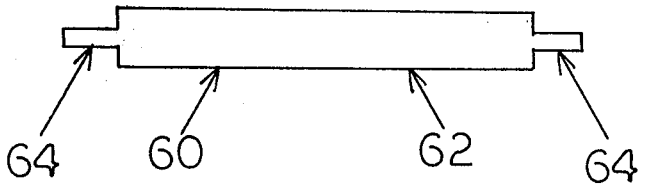
FIG. 4 illustrates a locking bar of the type used in the present invention.

As shown in FIGS. 1, 2 and 3, rotation of left roller tappet 20 and right roller tappet 34 is prevented by locking bar 60 which passes through slot 57 formed in right tubular member 56, through slot 47 in left tubular member 46 and apertures 49 and 59 in tubular members 46 and 56, respectively. Locking bar 60 has a wide central portion 62 and two narrow end portions 64 which pass through apertures 49 and 59 formed in left tubular member 46 and right tubular member 56, respectively. As shown in FIG. 3 apertures 49 and 59 and slots 47 and 57 are large enough to allow end portions 64 of locking bar 60 to pass therethrough and the longitudinal dimension of each slot 47 and 57 and each aperture 49 and 59 is large enough to allow tubular members 46 and 56 to move longitudinally to follow cam surfaces 22 and 36 but each aperture 49 and 59 is small enough to prevent central portion 62 of locking bar 60 from passing therethrough. Preferably, the longitudinal dimensions of apertures 49 and 59 are short enough to ensure that the end portions 64 of locking bar 60 will be retained therein and not become displaced therefrom during operation when a locking bar of suitable length is used. While the form of locking bar shown and described above is the most preferred embodiments because it is light and can easily be stamped from sheet metal, in some circumstances it may be advantageous to use a cylindrical or other shape locking bar. It is only necessary that shoulder portions of sufficient dimension to prevent the locking bar from passing through apertures 49 and 59 be placed on said locking bar spaced from each other by a distance which is less than the distance between apertures 49 and 59. Preferably, the shoulder portions will be spaced apart more than the distance between slots 47 and 57. In any event, the total length of the locking bar should be such that the locking bar will be retained in slots 47 and 57 and apertures 49 and 59.

Figure 5:
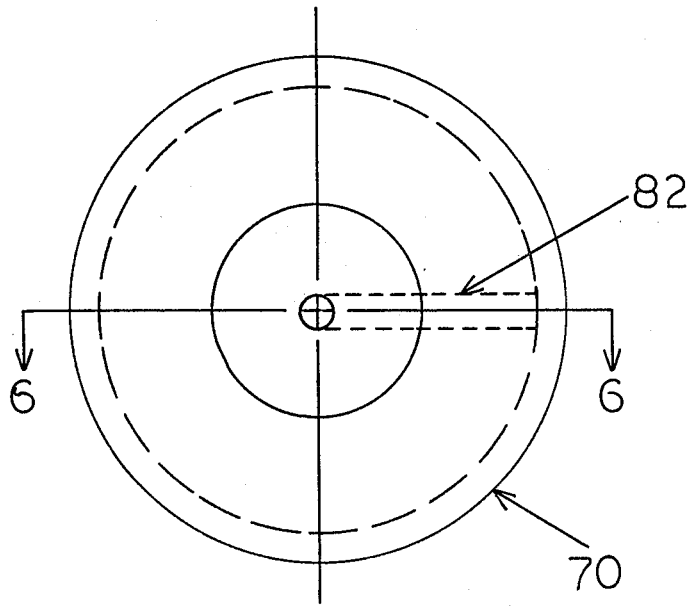
FIG. 5 illustrates a pushrod seat of a type useful in the practice of the present invention.
Figure 6:
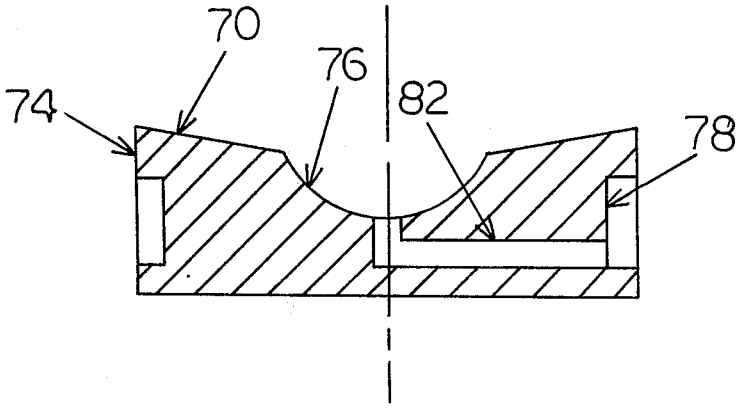
FIG. 6 is a sectional view along line 6—6 in FIG. 5.
Figure 7:
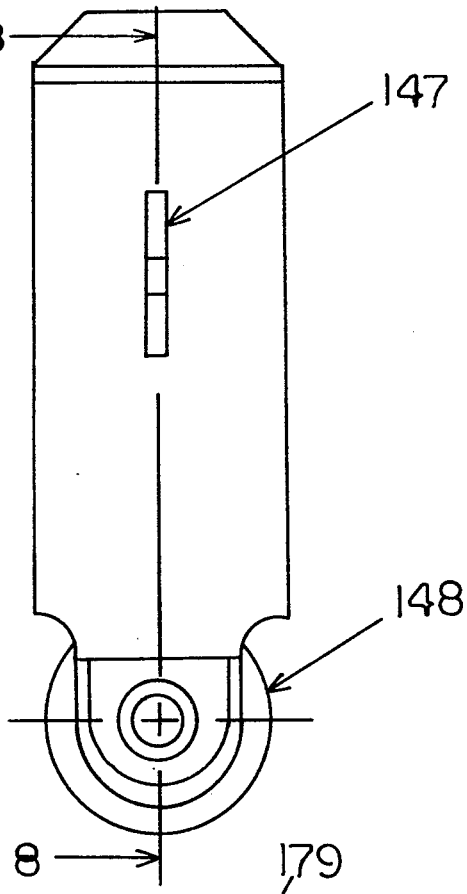
FIG. 7 illustrates an alternative lifter body useful in the practice of another embodiment of the present invention.
Figure 8:
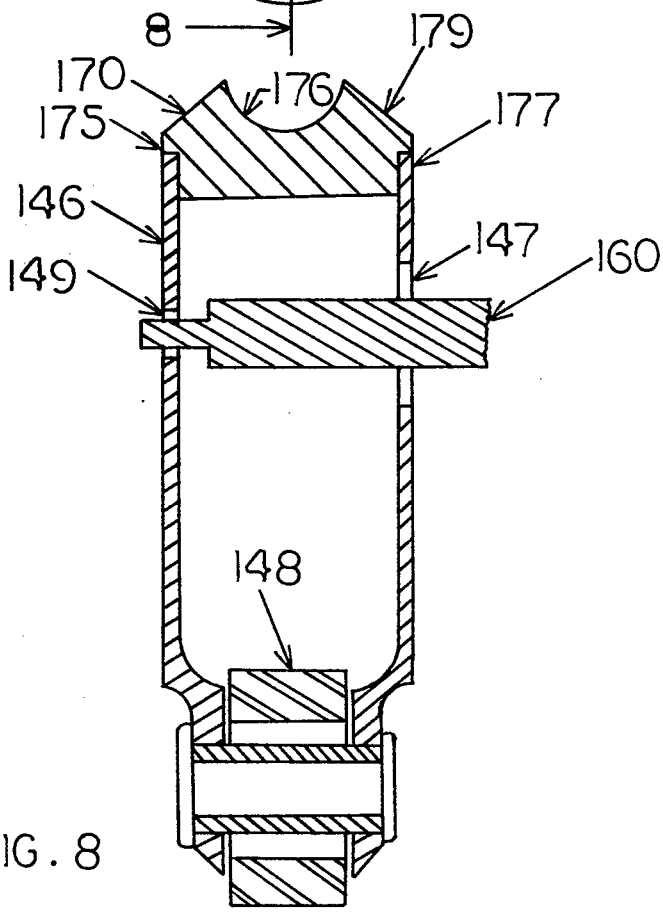
FIG. 8 is a sectional view along line 8—8 in FIG. 7.

In the embodiment shown and described above, it is advantageous to mount the pushrod 26 and 38 in tubular members 46 and 56 by means of pushrod seat 70 such as is shown in phantom in FIG. 3 resting on shoulder 72 and in detail in FIGS. 5 and 6. Pushrod seat 70 shown in FIGS. 5 and 6 comprises substantially cylindrical body portion 74 having substantially spherical surface 76 formed in the upper face thereof and circumferential groove 78 extending around cylindrical body portion 74. Aperture 80 is formed in the wall of a tubular member 46 or 56 communicating with circumferential groove 78. In this manner, oil can be forced through aperture 80 into groove 78, through passageway 82 and onto sperical surface 76 as tubular member 46 moves longitudinally. (If pushrod 26 is hollow, then rocker arm 28 can be lubricated simultaneously with spherical surface 76.) FIGS. 7 and 8 illustrate another embodiment which is slightly lighter than the embodiment described in the preceding paragraphs. In FIGS. 7 and 8 locking bar 160 passes through slot 147 and aperture 149 which are located on a line which is parallel to the axis of rotation of roller bearing 148 and which passes through the longitudinal axis of the tappet. In this embodiment, the left and right roller tappets can be similar, whereas in the previous embodiment left tappet 20 and right tappet 21 were not identical but rather have slots 47 and 57 and apertures 49 and 59 located differently on each tappet. For example, in FIG. 1, aperture 49 was on the left side of left roller tappet 20 and slot 49 on the right while right roller tappet 21 had aperture 59 on the right side and slot "57" on the left. Further, the construction shown in FIGS. 7 and 8 saves weight since the pushrod can be shortened and it is not necessary to form a shoulder in the tubular member. This is made possible by forming conical pushrod seat 170 with shoulder portion 175 the outside diameter of which is the same as the inside diameter of tubular body member 146. Conical portion 179 having substantially spherical surface 176 formed therein joins shoulder portion 175 and provides a seat for the pushrod (not shown).

Figure 9:
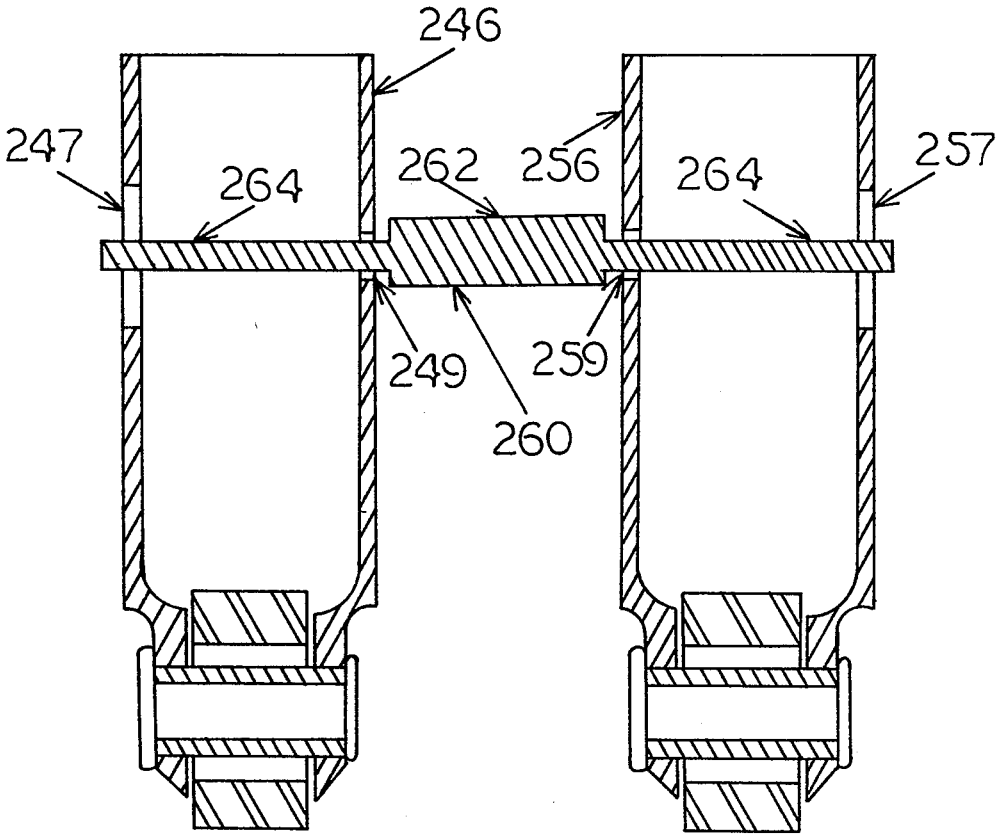
FIG. 9 is a sectional view illustrating another embodiment of the present invention.

FIG. 9 illustrates another embodiment of the invention in which narrowed end portions 264 of locking bar 260 are disposed within apertures 249 and 259 as well as slots 247 and 256 formed in tubular members 246 and 256 respectively. The embodiment shown in FIG. 9 differs from those shown in FIGS. 1 through 8 principally in that end portions 264 of locking bar 260 extend entirely through tubular members 246 and 256 and apertures 249 and 259 are adjacent to each other rather than being located on opposite sides of tubular members 246 and 256.

It will be apparent that many variations may be made in the details of the apparatus while remaining within the spirit of the invention, therefore as my invention.

I claim:

1. A non-rotatable valve lifter mechanism for actuating intake and exhaust valves in an internal combustion engine, comprising:

a first tubular member having a bifurcation formed in one end thereof, a first roller bearing mounted in said bifurcation of said first tubular member, said first tubular member having an aperture and a slot formed therein, said slot being substantially parallel to the longitudinal axis of said first tubular member;

a second tubular member having a bifurcation formed in one end thereof, a second roller bearing mounted in said bifurcation in said second tubulor member, said second tubular member having a slot and an aperture formed therein, said slot being substantially parallel to the longitudinal axis of said second tubular member; and a locking bar supported by and preventing rotation of said tubular members, said locking bar having a first end portion, a first shoulder portion adjacent to said first end portion, a second end portion, a second shoulder portion adjacent to said second end portion, each said end portion being adopted to pass through both said slots and said apertures, each said shoulder portion having at least one dimension too great to allow passage through said apertures, the end portion of said locking bar passing through said apertures.

2. The non-rotatable valve lifter mechanism of claim 1 wherein the distance between said shoulder portions is greater than the distance between said slot in said first tubular member and said slot in said second tubular member.

3. The non-rotatable valve lifter mechanism of claim 2 wherein the distance between said shoulder portions is less than the distance between said aperture in said first tubular member and wherein the total length of said locking bar is sufficient to maintain said locking bar within said slots as said tubular members reciprocate.

4. The non-rotatable valve lifter mechanism of claim 1 wherein a line substantially parallel to the axis of rotation of each said roller bearing can be passed through said slot and aperture in each said tubular member.

5. The non-rotatable valve lifter mechanism of claim 4 wherein said locking bar is a substantially planar member, the plane of said member being parallel to the longitudinal axes of said tubular members.

6. The non-rotatable valve lifter mechanism of claim 4 wherein said locking bar reciprocates with said tubular members, and is of sufficient length to be maintained within said slots and apertures as said tubular members reciprocate.

7. The non-rotatable valve lifter mechanism of claim 4 wherein each said line passes through the longitudinal axis of each said tubular member and further comprising a pushrod seat mounted on each said tubular member at the end opposite said roller bearing, each said pushrod seat having a bearing surface formed therein.

8. The device of claim 7 wherein each said pushrod seat has a substantially cylindrical insertable portion having an outside diameter which is substantially equal to the inside diameter of each said tubular member, a shoulder means joined to said insertable portion for mounting said pushrod seat on said tubular member and a portion having a bearing surface formed herein.

9. The device of claim 1 further comprising a pushrod seat disposed within said tubular member between said first roller bearing and said first aperture, said first roller bearing and said first aperture, said pushrod seat including a substantially cylindrical member having a bearing surface formed therein in the face opposite said roller bearing, having a groove formed in the cylindrical surface of said cylindrical member and having an aperture formed therein, said aperture connecting said bearing surface with said groove, and wherein a passage is formed in said first tubular member extending from the interior of said first tubular member.

10. The non-rotatable valve lifter mechanism of claim 1 wherein said locking bar is a substantially planar member, the plane of said member being parallel to the longitudinal axes of said tubular members.

11. The non-rotatable valve lifter mechanism of claim 1 wherein said locking bar reciprocates with said tubular members and is of sufficient length to be maintained within said slots and apertures as said tubular member reciprocate.

* * * * *